US011382436B1

(12) United States Patent
Vosters

(10) Patent No.: US 11,382,436 B1
(45) Date of Patent: Jul. 12, 2022

(54) BED FRAME OF A CANOPY STYLE CONSTRUCTION TYPICALLY FOUND IN A HOME SETTING INTEGRATING ASSISTIVE COMPONENTS THEREIN

(71) Applicant: Joseph Peter Vosters, Appleton, WI (US)

(72) Inventor: Joseph Peter Vosters, Appleton, WI (US)

( * ) Notice: Subject to any disclaimer, the term of this patent is extended or adjusted under 35 U.S.C. 154(b) by 324 days.

(21) Appl. No.: 16/440,551

(22) Filed: Jun. 13, 2019

Related U.S. Application Data

(60) Provisional application No. 62/684,926, filed on Jun. 14, 2018.

(51) Int. Cl.
*A47C 29/00* (2006.01)
*A47C 19/02* (2006.01)
*A47C 21/08* (2006.01)

(52) U.S. Cl.
CPC ..... *A47C 29/003* (2013.01); *A47C 19/022* (2013.01); *A47C 21/08* (2013.01)

(58) Field of Classification Search
CPC ..... A47C 29/003; A47C 21/08; A47C 19/022; A61G 7/0536; A61G 7/053; A61G 7/0533; A61G 7/051
See application file for complete search history.

(56) References Cited

U.S. PATENT DOCUMENTS 1,582,487 A 4/1926 Shank
1,698,754 A 1/1929 Gadbois
1,699,026 A 1/1929 Schumacher et al.
3,811,151 A * 5/1974 Kuemmerlin ..... E06C 1/32 16/329
4,003,479 A 1/1977 Reyer
D256,526 S * 8/1980 Johnson ..... 5/200.1
4,642,824 A 2/1987 Hodges
4,686,727 A 8/1987 Wilkinson
5,038,430 A 8/1991 Bly
5,337,430 A * 8/1994 Schlein ..... A47C 21/00 5/662
5,570,483 A * 11/1996 Williamson ..... A61G 1/0293 177/144
5,732,423 A 3/1998 Weismiller et al.
5,836,026 A 11/1998 Reed
6,058,531 A 5/2000 Carroll
6,163,906 A 12/2000 Kay
6,581,897 B2 6/2003 Ruschke
(Continued)

*Primary Examiner* — Eric J Kurilla
(74) *Attorney, Agent, or Firm* — Brannen Law Office, LLC

(57) ABSTRACT

The present invention relates to a bed frame of a canopy style construction typically found in a home setting integrating assistive components therein, exemplary assistive components optionally including one or more of a trapeze device, a balance pole and an assist rail, and also wherein there is an option that the assistive components to be selectably concealed. The frame has four corner posts, two longitudinal rails and two lateral rails. A cross-brace and two longitudinal braces are provided for supporting a trapeze assembly. An integrated night stand having an integrated assist rail that moves from a storage position to a deployed position is provided. An integrated balance pole with a top piece and bottom piece, and a base, is provided. Structures can be provided for concealing the assistive components when they are not in use.

21 Claims, 23 Drawing Sheets

(56) References Cited

U.S. PATENT DOCUMENTS

| | | | | |
|---|---|---|---|---|
| 6,725,484 | B2 | 4/2004 | Drenik | |
| 6,934,980 | B2 * | 8/2005 | Harney | A61G 7/0533 5/81.1 HS |
| 7,036,160 | B1 | 5/2006 | Pecoraro | |
| 7,231,678 | B2 | 6/2007 | Parker | |
| 9,089,461 | B1 * | 7/2015 | Vosters | A47C 21/00 |
| 2001/0032362 | A1 * | 10/2001 | Welling | A61G 7/005 5/600 |
| 2003/0163871 | A1 | 9/2003 | Conlu et al. | |
| 2006/0162083 | A1 | 7/2006 | Heimbrock | |

* cited by examiner 30
45
40
60
455
440
445

410
450
400
430
380
370
15

BED FRAME OF A CANOPY STYLE CONSTRUCTION TYPICALLY FOUND IN A HOME SETTING INTEGRATING ASSISTIVE COMPONENTS THEREIN

This United States utility patent application claims priority on and the benefit of provisional application 62/684,926 filed Jun. 14, 2018, the entire contents of which are hereby incorporated herein by reference.

BACKGROUND OF THE INVENTION

1. Field of the Invention

The present invention relates to a bed frame of a canopy style construction typically found in a home setting integrating assistive components therein, exemplary assistive components optionally including one or more of a trapeze device, a balance pole and an assist rail, and also wherein there is an option that the assistive components to be selectably concealed.

2. Description of the Related Art

There have been many advances in beds over the years. One area of improvement has been related to assist devices that can be used in conjunction with beds.

For example, balance poles exist that can be supported by the floor and ceiling of a room. Also, side assist rails exist having a base that can be slid under the mattress and above the mattress support surface. A further example is a triangular trapeze can be cantilevered over the head section of the bed.

A common theme amongst these types of devices are that they are not designed necessarily to be used with other devices. Another common theme is that the traditional devices are not designed to be integrated into the bed framework. A further common theme is that the traditional devices are not designed to be concealed when in a storage position.

Some beds do exist in a hospital setting having attachments for patient transport or other reasons. Yet, a hospital setting is vastly different than a home or even a hotel setting. There is a need in a hospital setting that the beds be as efficient as possible and easily cleaned. Concealability structures can inhibit efficiency and cleanability.

On the other hand, concealability of assistive components, when not in use, may be highly desirable in a home or hotel setting.

Thus, there exists a need for a bed frame of a canopy style construction typically found in a home setting integrating assistive components therein, exemplary assistive components optionally including one or more of a trapeze device, a balance pole and an assist rail, and also wherein there is an option that the assistive components to be selectably concealed that solves these and other problems.

SUMMARY OF THE INVENTION

The present invention relates to a bed frame of a canopy style construction typically found in a home setting integrating assistive components therein, exemplary assistive components optionally including one or more of a trapeze device, a balance pole and an assist rail, and also wherein there is an option that the assistive components to be selectably concealed. The frame has four corner posts, two longitudinal rails and two lateral rails. A cross-brace and two longitudinal braces are provided for supporting a trapeze assembly. An integrated night stand having an integrated assist rail that moves from a storage position to a deployed position is provided. An integrated balance pole with a top piece and bottom piece, and a base, is provided. Structures can be provided for concealing the assistive components when they are not in use.

According to one advantage of the present invention, a canopy style overbed support assembly can be modified and used with the present invention to integrate assistive components thereto. The present invention can be used with both stationary and adjustable bed designs.

According to another advantage of the present invention, the assistive components can be moveable between storage positions and deployed positions. In some or all embodiments, the storage positions can also be concealed positions. In this regard, the assistive components can be concealed from view (i.e. essentially hidden) when not in use. This is advantageous as it allows the bed to be both functional and aesthetically pleasing.

In a hotel environment, such an advantage can be significant as rooms equipped with the present invention can be dual use rooms (handicap and regular use) offering up additional flexibility in room bookings and guests stays. Handicap accessible rooms are often used as overflow rooms for non-handicapped guests and concealment of assistive components (when not needed) would enhance the appearance of the dual-use rooms therefore enhancing the guest experience and hotels offerings.

According to another advantage of the present invention, a trapeze assembly can be provided and integrated into the overbed support assembly. The trapeze assembly is operable longitudinally within the head region of the bed. A user can use the trapeze assembly to position themselves within the bed and optionally to move themselves closer to other components.

The trapeze bar can be deployed for use or stored. In a storage position, the trapeze bar can be stored behind the head board in a pocket concealing it from view. The pocket can advantageously provide a space for the trapeze bar when it can be stored and prevent damage to an adjacent room wall. A box can also be provided at the head end lateral rail. The box can have slots that allow cuffs and straps to pass wherein they can be stored within the box when in the storage position. Covers can be advantageously provided to further conceal the components when in the storage position.

According to another advantage of the present invention, assist rails can be integrated into a night stand used with the present invention.

According to a still further advantage yet of the present invention, the assist rails can be integrated into a frame post resulting in a very sturdy structure.

According to a still further advantage yet of the present invention, the assist rails can be moved between a storage position and a deployed position. In a fully deployed position, a movable section is inline with a stationary section a fixed distance from the mattress.

According to a still further advantage yet of the present invention, the movable section can be pivotally connected to the fixed section. The pivot can be offset from the centerline of the fixed section. This advantageously allows the movable section to be stored in position that is parallel to the fixed section to take up the least amount of space.

According to a still further advantage yet of the present invention, the movable section can be locked into intermediate positions, such as 45 degrees, to allow flexibility of use.

According to a still further advantage yet of the present invention, concealers such as shrouds can be used around the night stand to conceal the movable section when it is not in use. One of the concealers can be selectably placed on either side of the fixed section to either expose or conceal side rails.

According to a still further advantage yet of the present invention, a balance pole assembly is provided that can be integrated into the frame. The balance pole assembly is movable between storage and deployed positions.

According to a still further advantage yet of the present invention, the balance pole assembly can have a base and a balance pole. The base can be stored under the mattress when not in use. The balance pole can be stored along a longitudinal rail of the overbed support assembly when not in use.

According to a still further advantage yet of the present invention, the balance pole can be condensed in length, pivoted to be parallel with the longitudinal rail and slid laterally into close proximity with the longitudinal rail.

According to a still further advantage yet of the present invention, a box can be provided adjacent the longitudinal rail to conceal the balance pole when it is in the storage position.

According to a still further advantage yet of the present invention, the base and balance pole can be removably joined together when the balance pole assembly is in the deployed position.

According to a still further advantage yet of the present invention, the base can have a structure that allows the base to only lay flat when on in the fully deployed position or the storage position. In this regard, the base, when in the deployed position, laterally locks the balance pole in a lateral position relative to the mattress for stability purposes.

Other advantages, benefits, and features of the present invention will become apparent to those skilled in the art upon reading the detailed description of the invention and studying the drawings.

DETAILED DESCRIPTION OF PREFERRED EMBODIMENTS

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1:
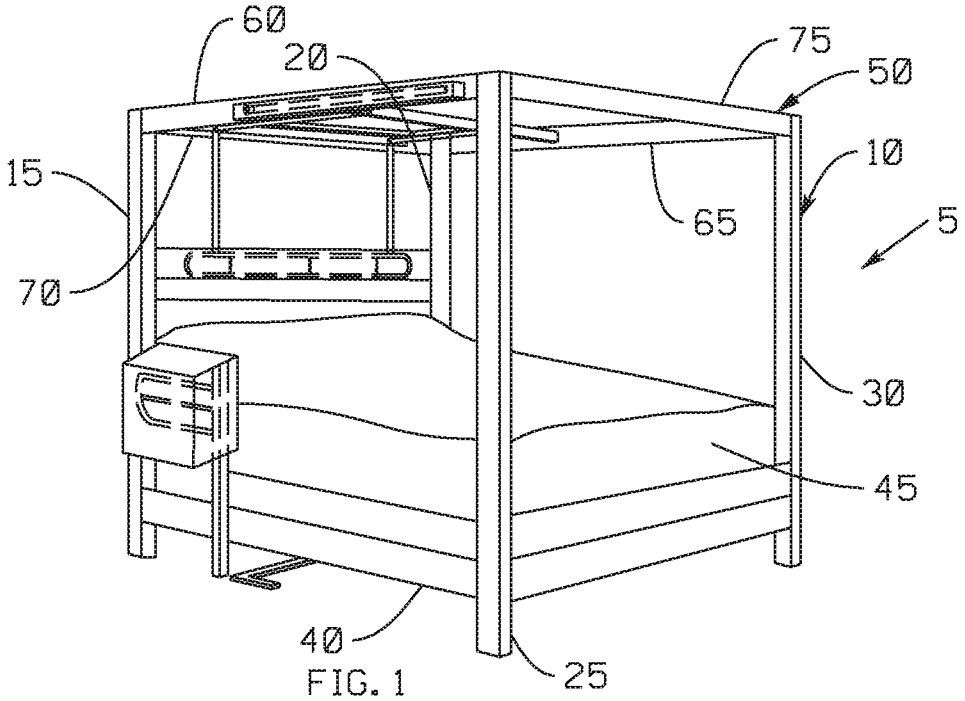
FIG. 1 is a perspective view of an embodiment of the present invention showing assistive components in a concealed position.
Figure 2:
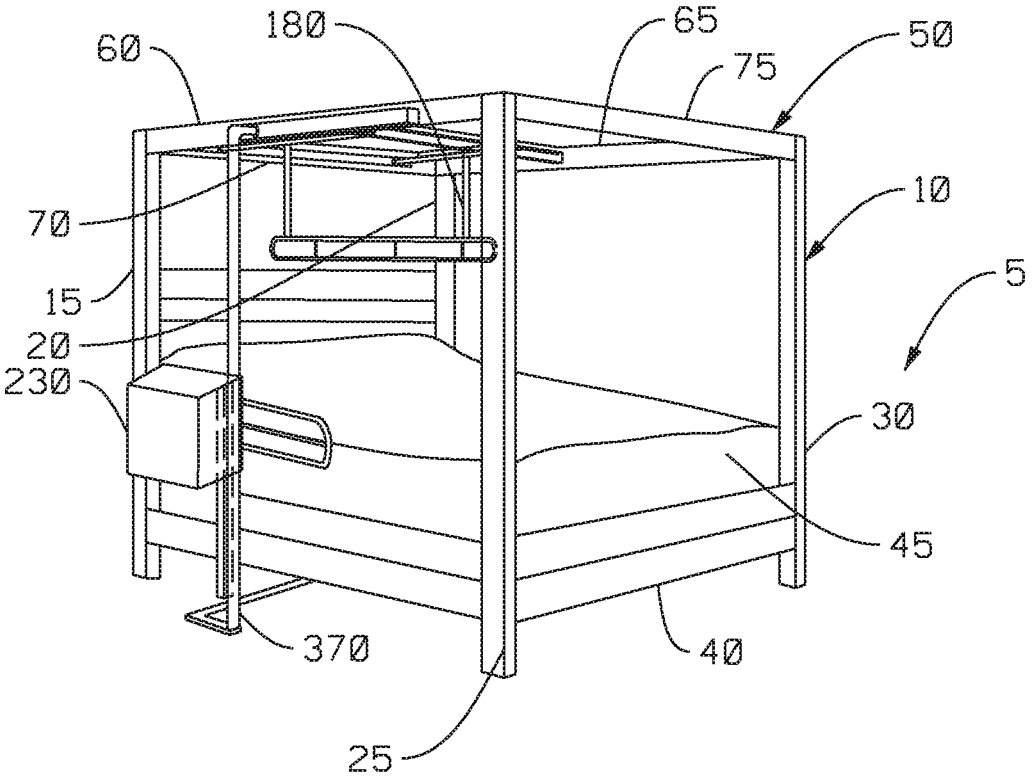
FIG. 2 is a perspective view of an embodiment of the present invention showing the assistive components in a deployed position.

The present invention is illustrated in the attached FIGS. 1-25. A bed 5 is shown in FIGS. 1-2. The bed 5 has a frame 10 with four corner posts 15, 20, 25 and 30, respectively. A mattress support 40 is provided for supporting a mattress 45. It is appreciated that the mattress support could be a traditional flat mattress or a movable/adjustable mattress without departing from the broad aspects of the present invention. An overbed support assembly 50 is provided. The overbed support assembly 50 can be a canopy style bed. It can have two longitudinal rails 60 and 65, which are parallel to each other and span the longitudinal length of the bed 5. It can also have two lateral rails 70 and 75, which are parallel to each other and can be at the respective head and foot ends of the bed 5.

Figure 6:
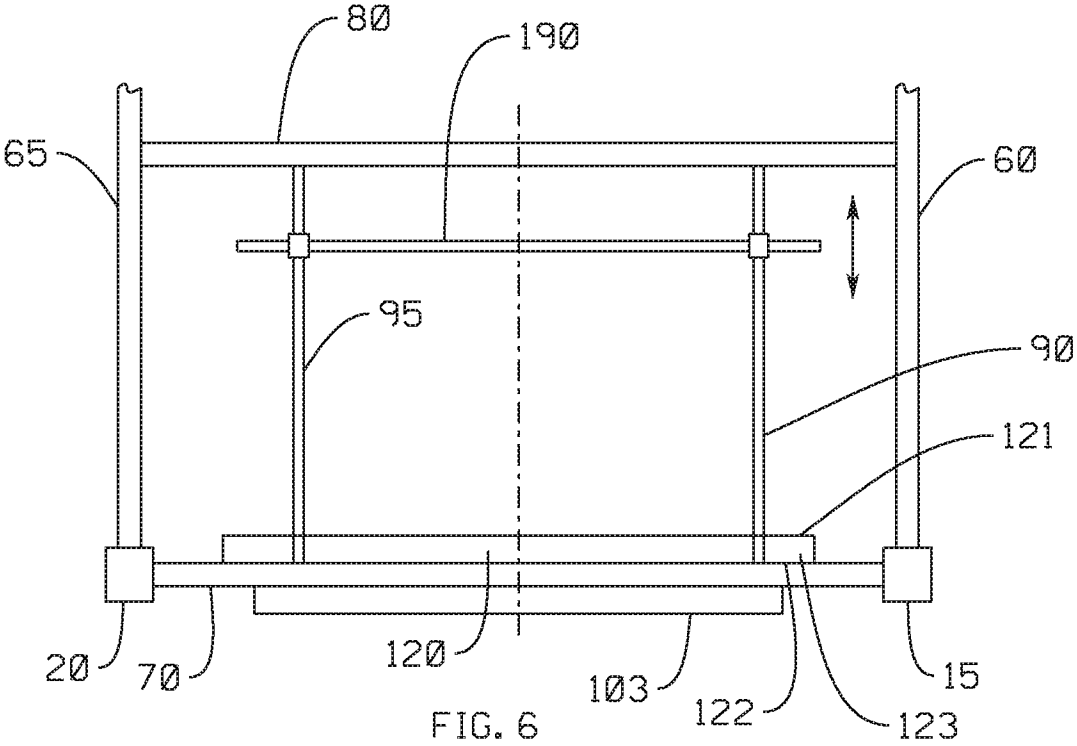
FIG. 6 is a partial overbed view of the trapeze bar.
Figure 7:
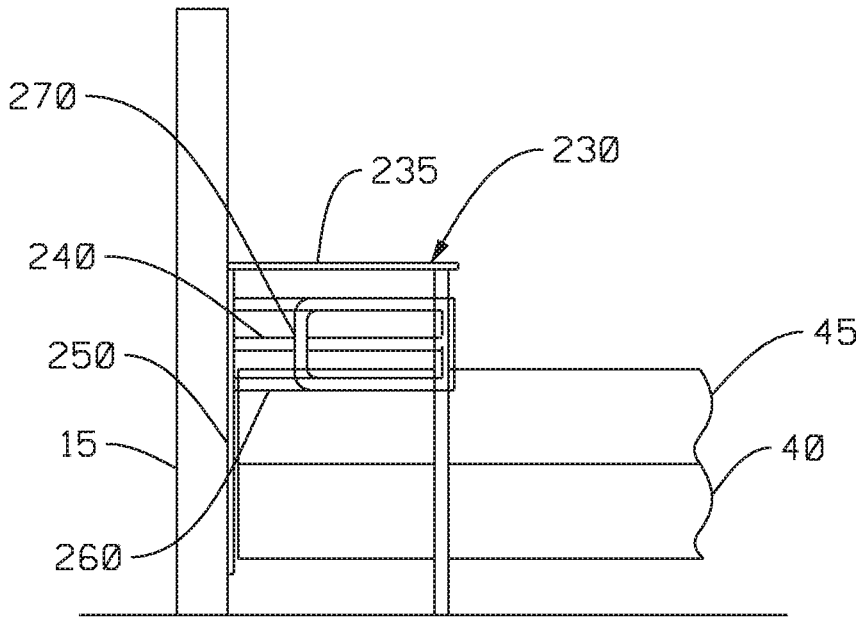
FIG. 7 is a side view of an embodiment of an assist rail in a storage position.
Figure 8:
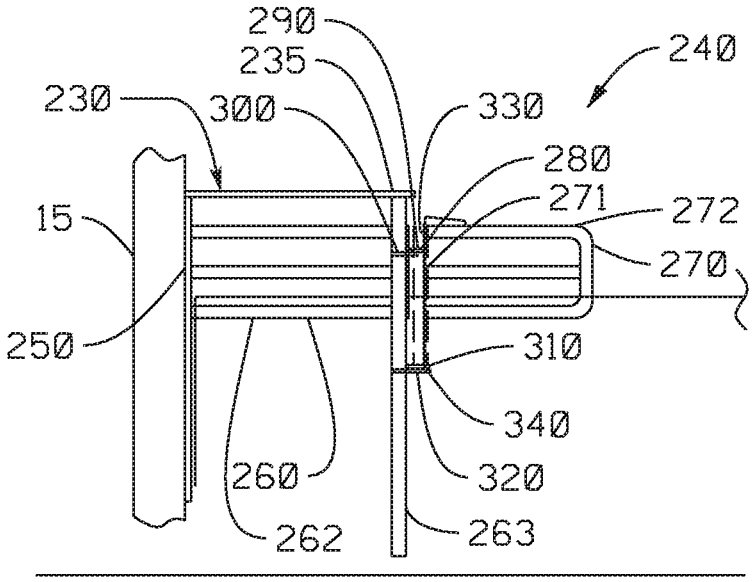
FIG. 8 is a side view of the assist rail in a deployed position.
Figure 9:
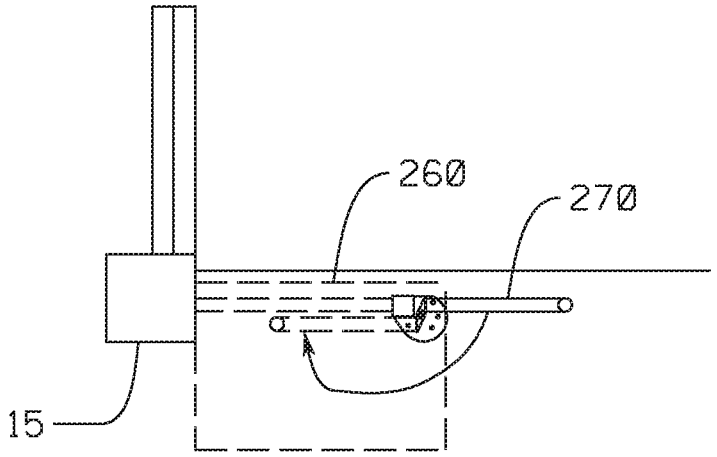
FIG. 9 is a top view of the assist rail.
Figure 10:
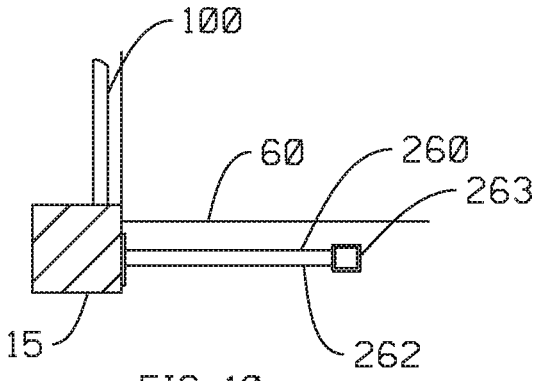
FIG. 10 is a close-up cross-sectional view showing the stationary section of the assist rail integrated into the frame post.
Figure 11:
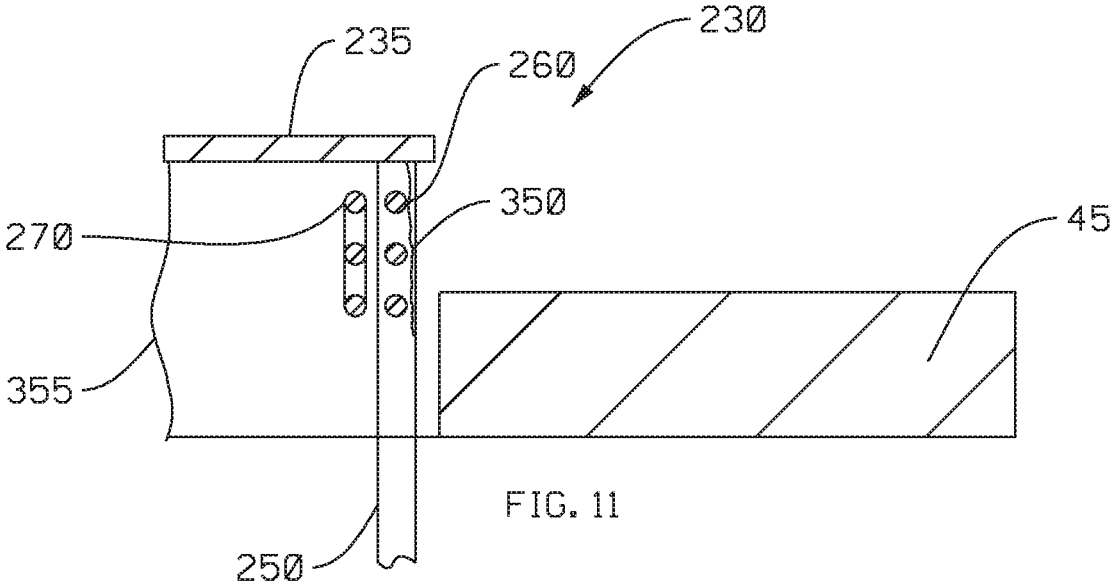
FIG. 11 is a cross-sectional end view of the assist rail.
Figure 12B:
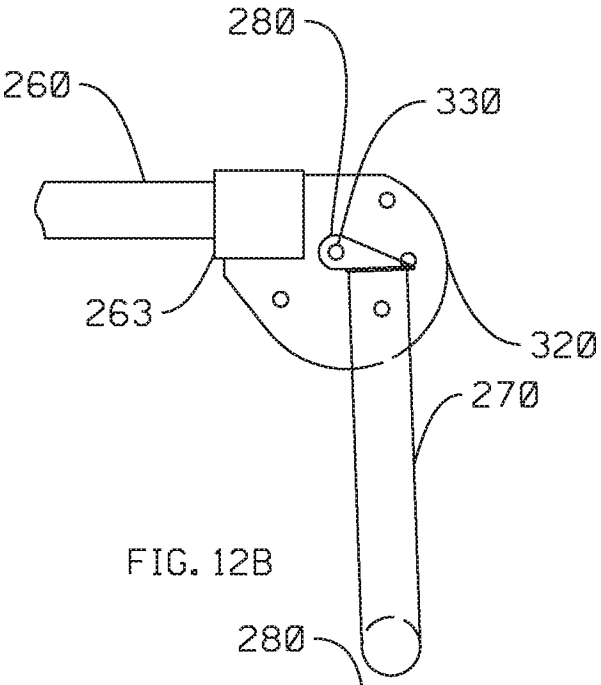
FIGS. 12-12C show various locking positions of a hinge.
Figure 12C:
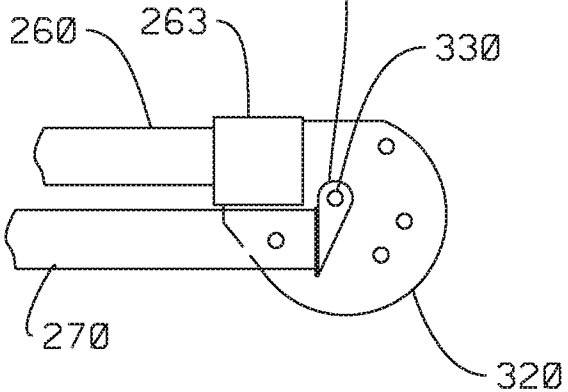
Figure 12:
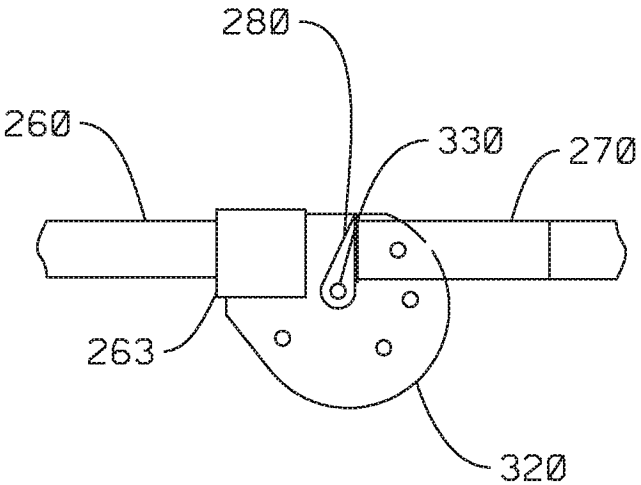
Figure 12A:
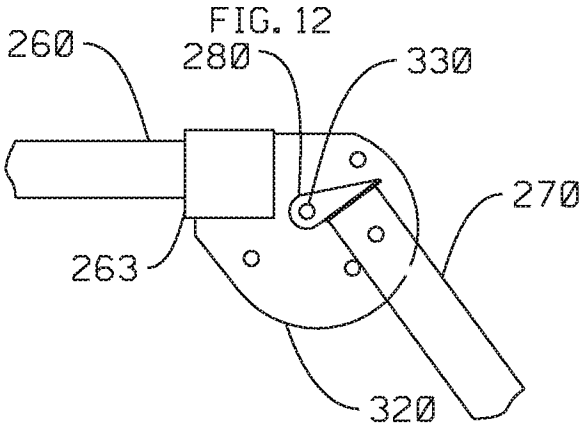
Figure 13:
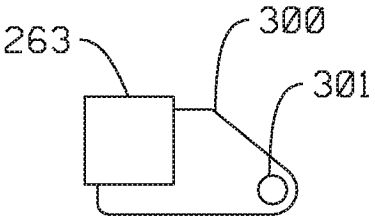
FIG. 13 is a top view of an upper hinge piece connected to the fixed section.
Figure 14:
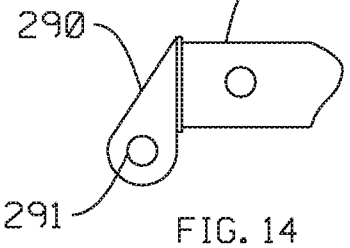
FIG. 14 is a top view of an upper hinge piece connected to the movable section.
Figure 15:
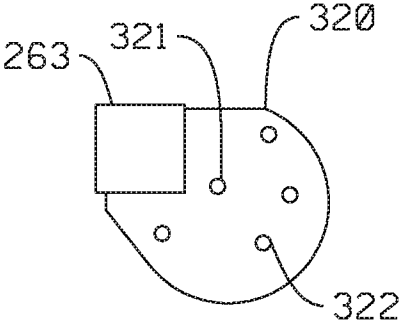
FIG. 15 is a top view of a lower hinge piece connected to the fixed section.
Figure 16:
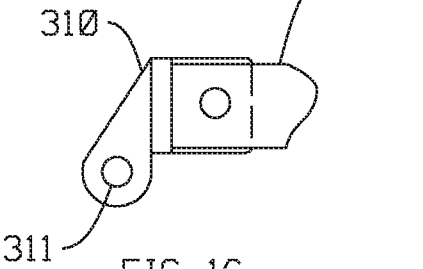
FIG. 16 is a top view of a lower hinge piece connected to the movable section.
Figure 17:
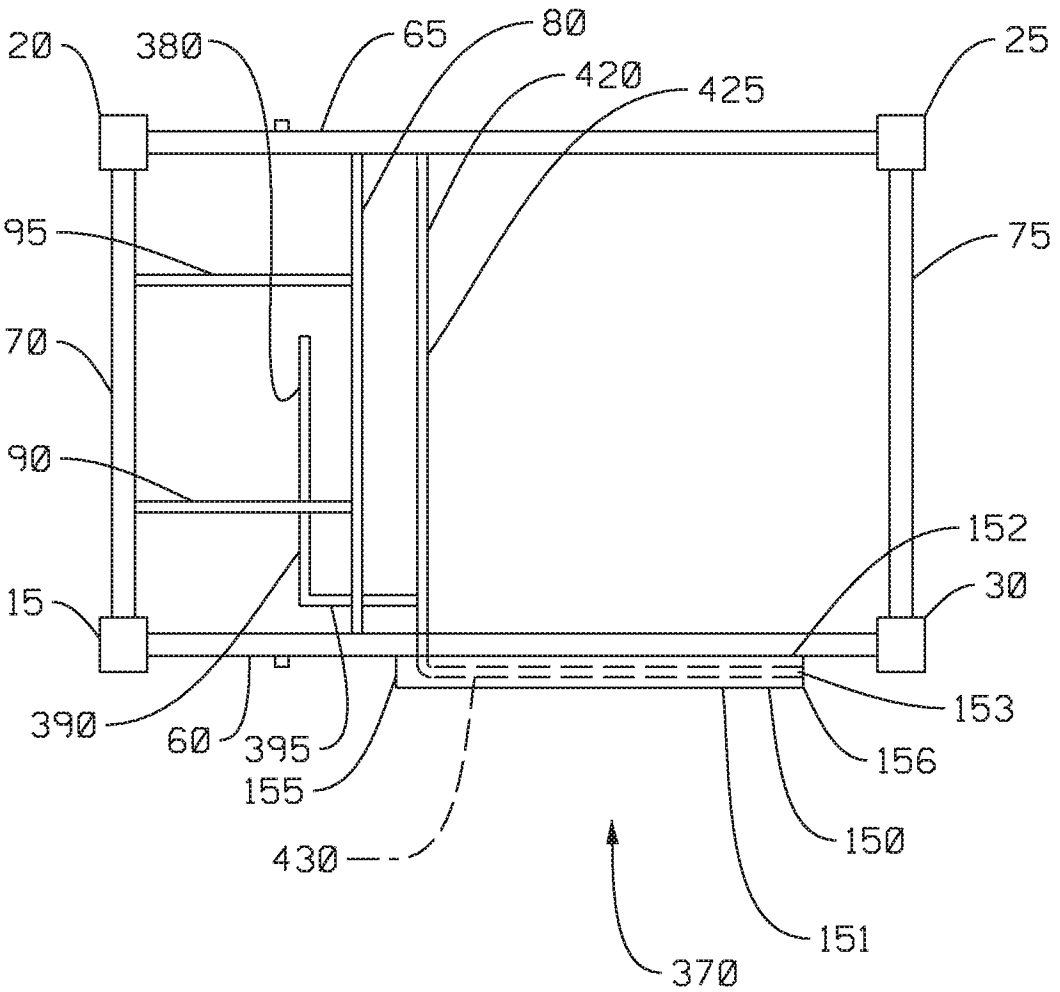
FIG. 17 is an overbed view of an embodiment of a balance pole assembly in a concealed position.
Figure 17A:
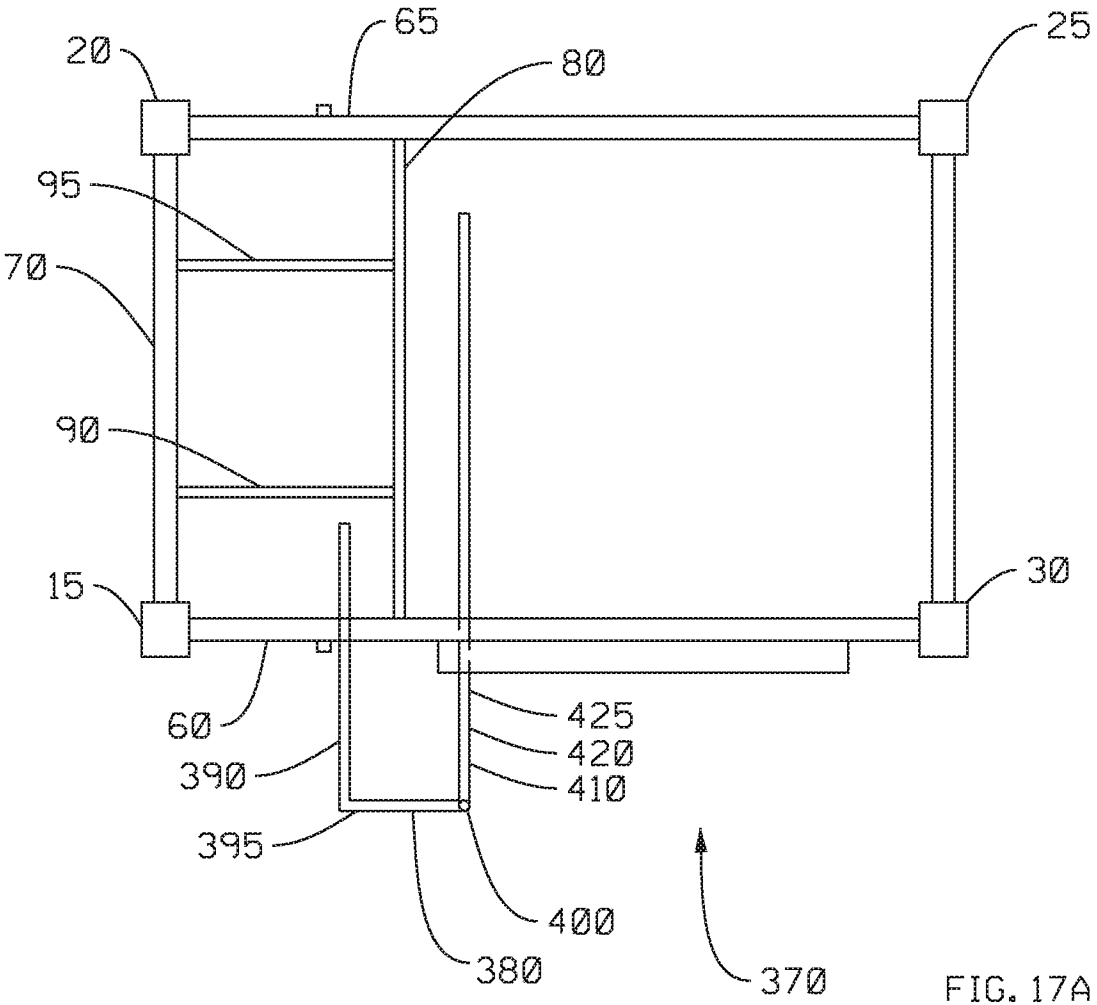
FIG. 17A is similar to FIG. 17 but shows the balance pole in a deployed position.
Figure 18:
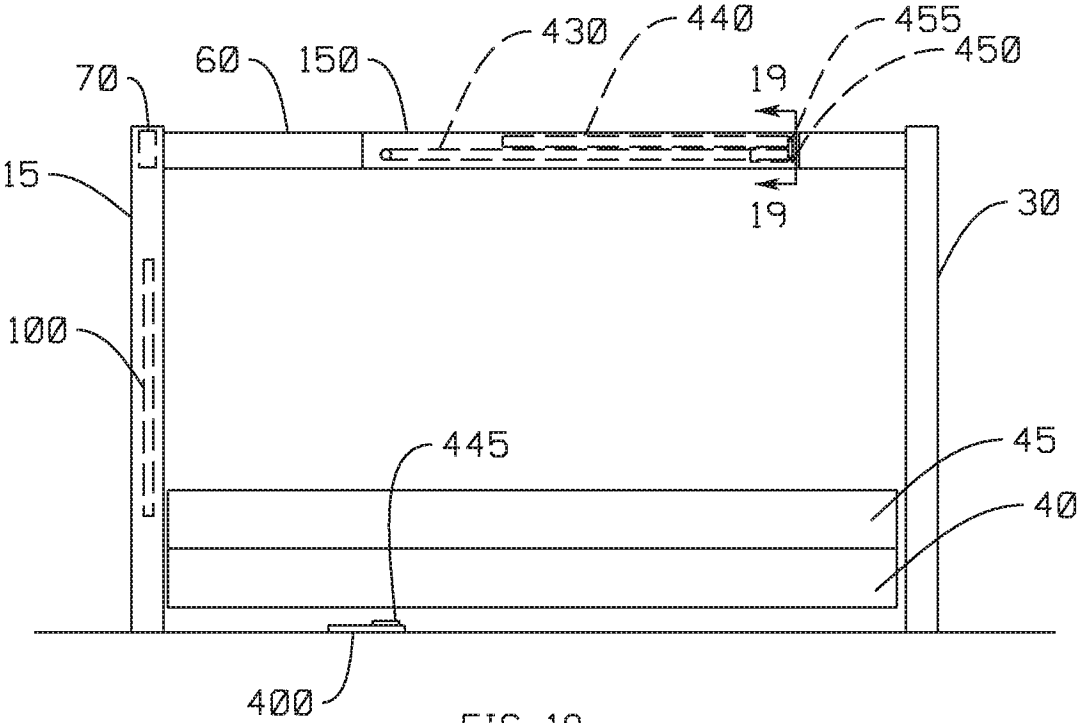
FIG. 18 is a side view of the balance pole assembly with a hinged pole design shown in a concealed position.
Figure 19:
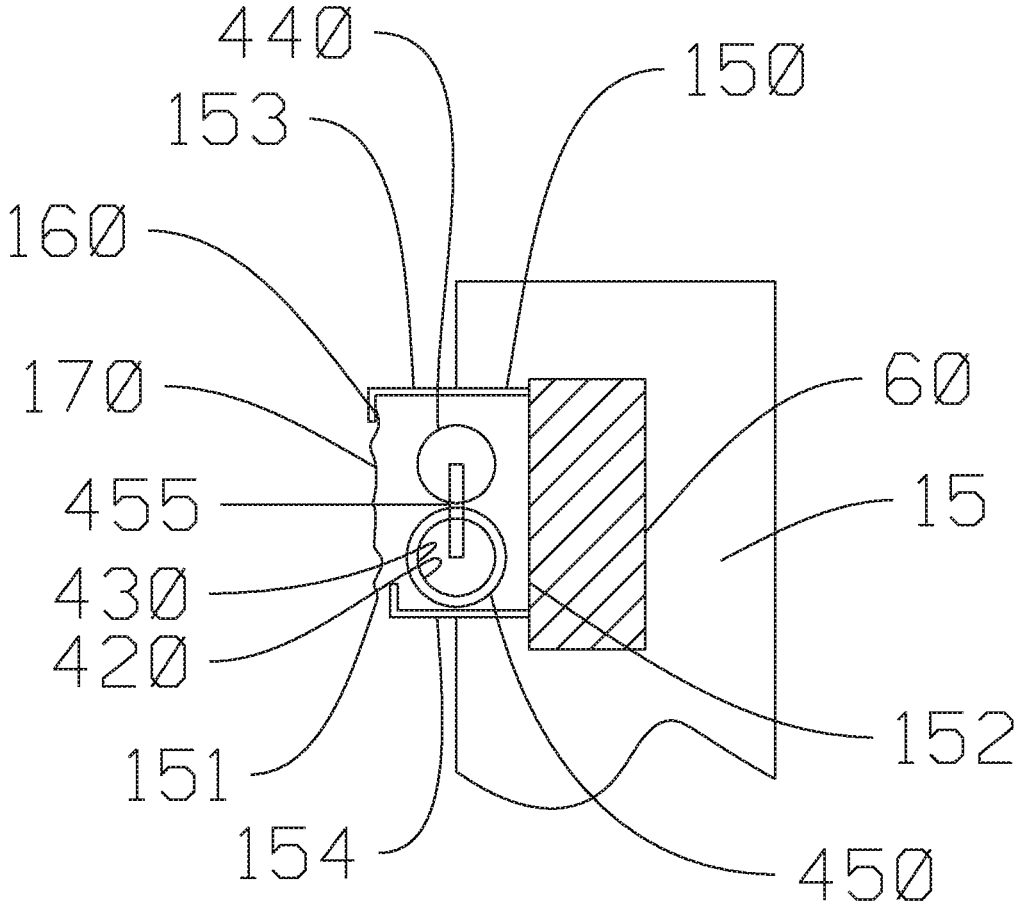
FIG. 19 is a close-up section view taken along line 19-19 in FIG. 18.
Figure 20:
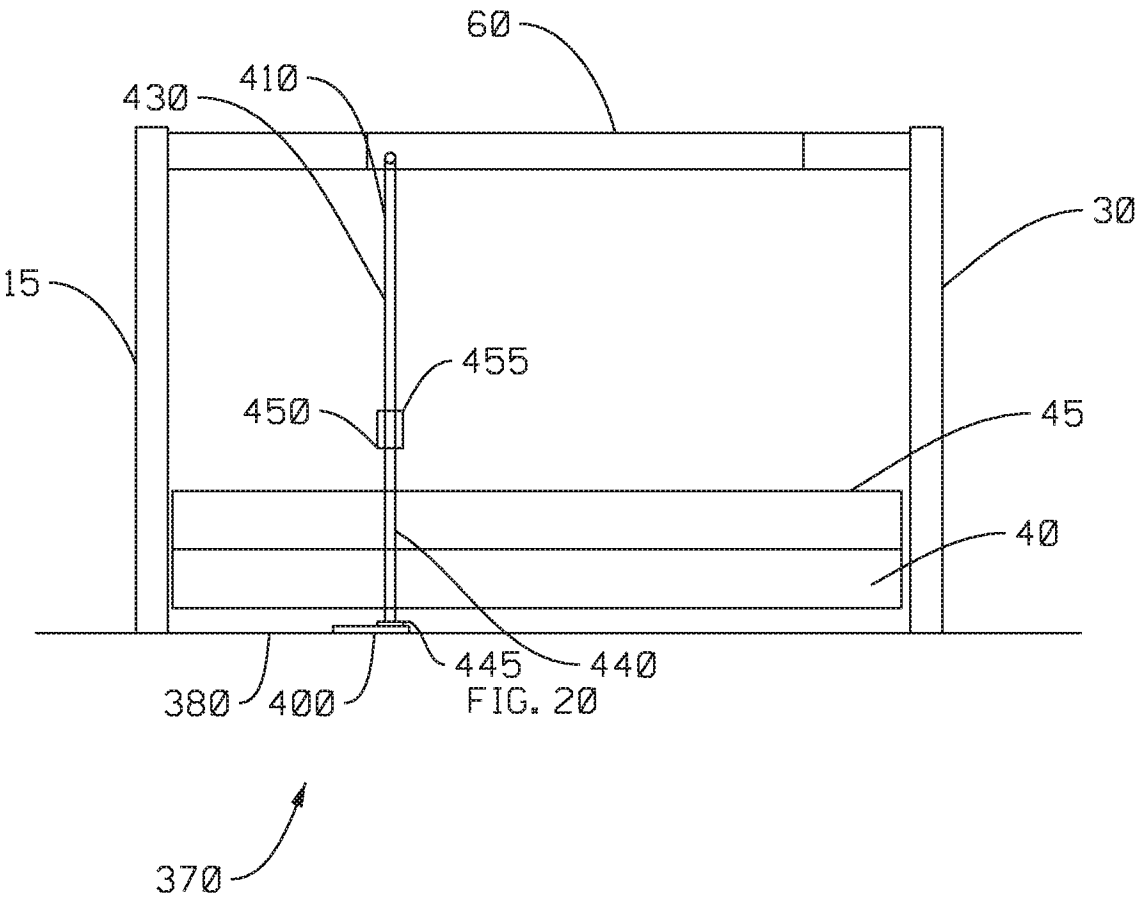
FIGS. 20-22 show a sequence of moving the balance pole assembly of FIG. 17 from a deployed position to a storage position.
Figure 21:
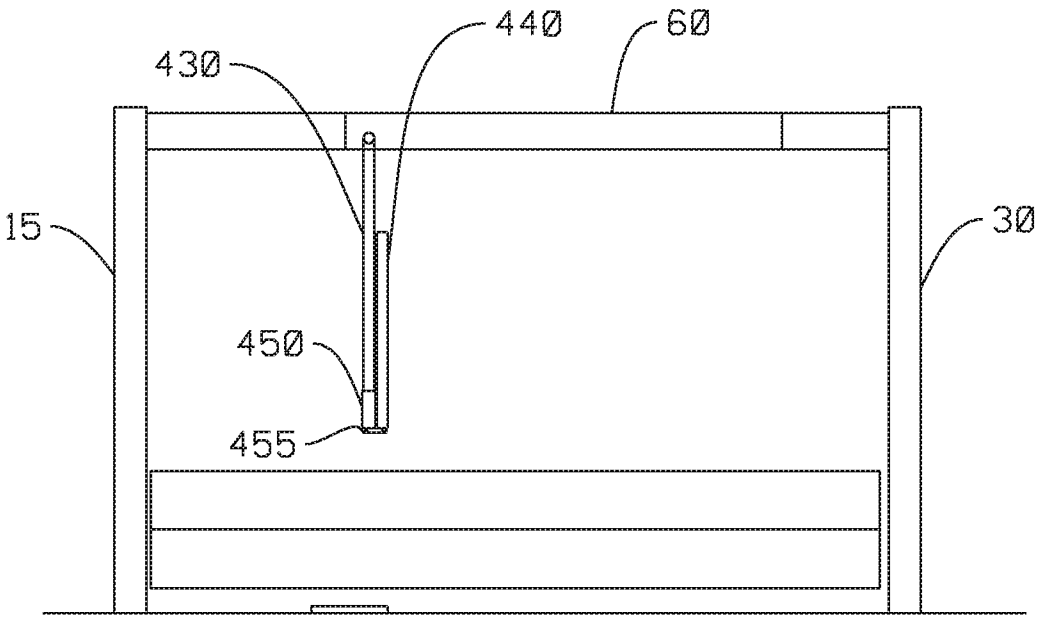
Figure 22:
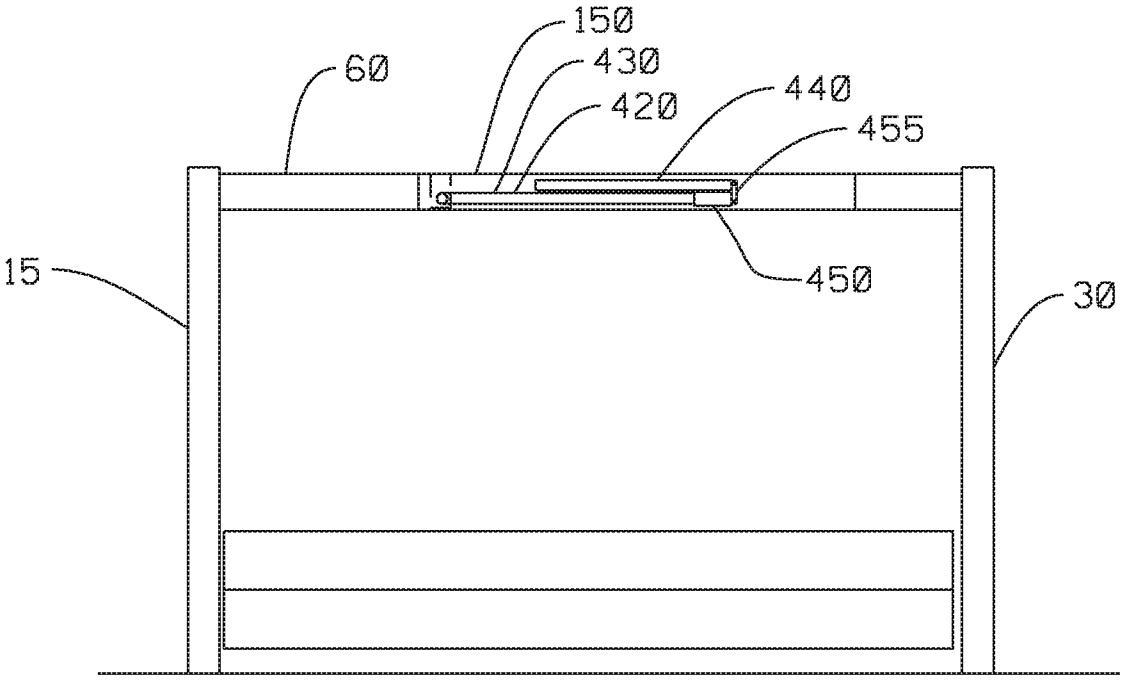

Turning now to FIG. 6, it is also seen that a cross-brace 80 can be provided along with two longitudinal braces 90 and 95. The braces 90 and 95 are preferably parallel to each other. Braces 90 and 95 are preferably round pipes.

Figure 3:
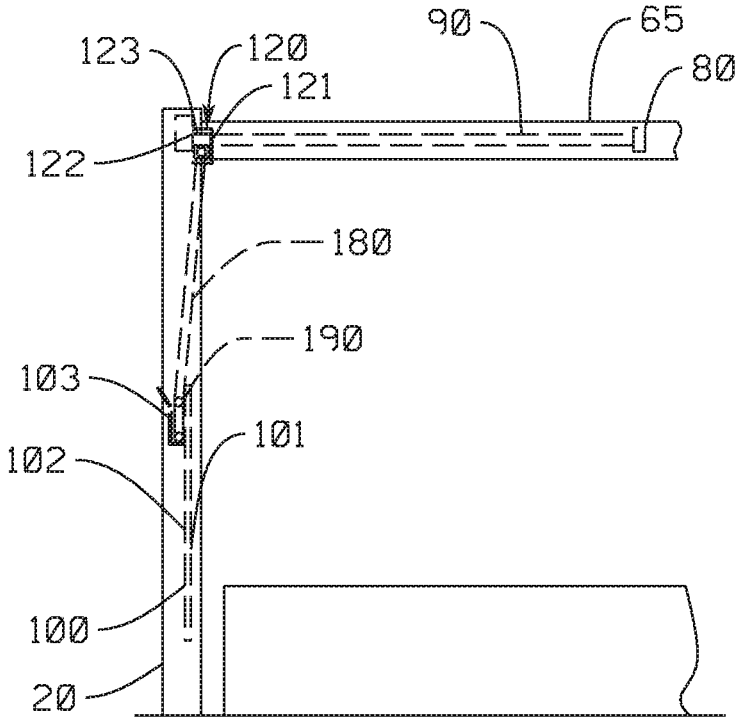
FIG. 3 is a side view showing an embodiment of a trapeze bar shown in a concealed or storage position.
Figure 3A:
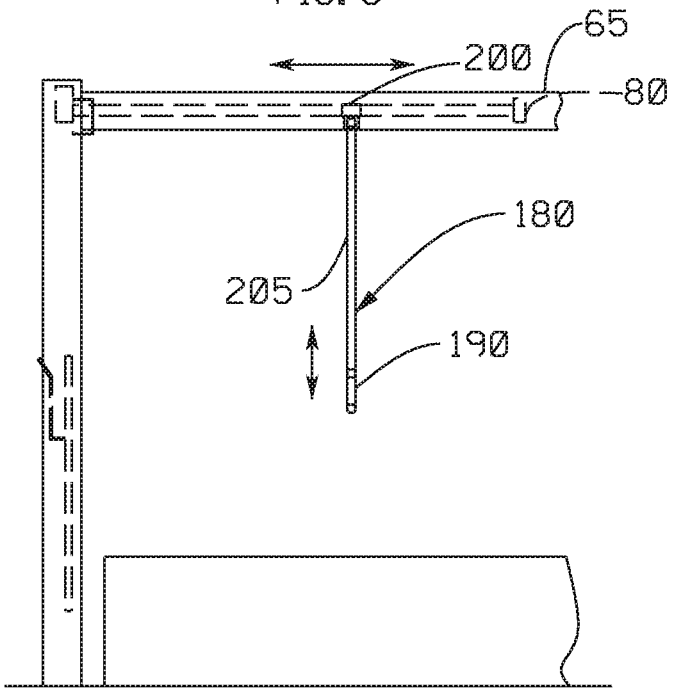
FIG. 3A is similar to FIG. 3 but shows the trapeze bar in a position suitable for use.
Figure 4:
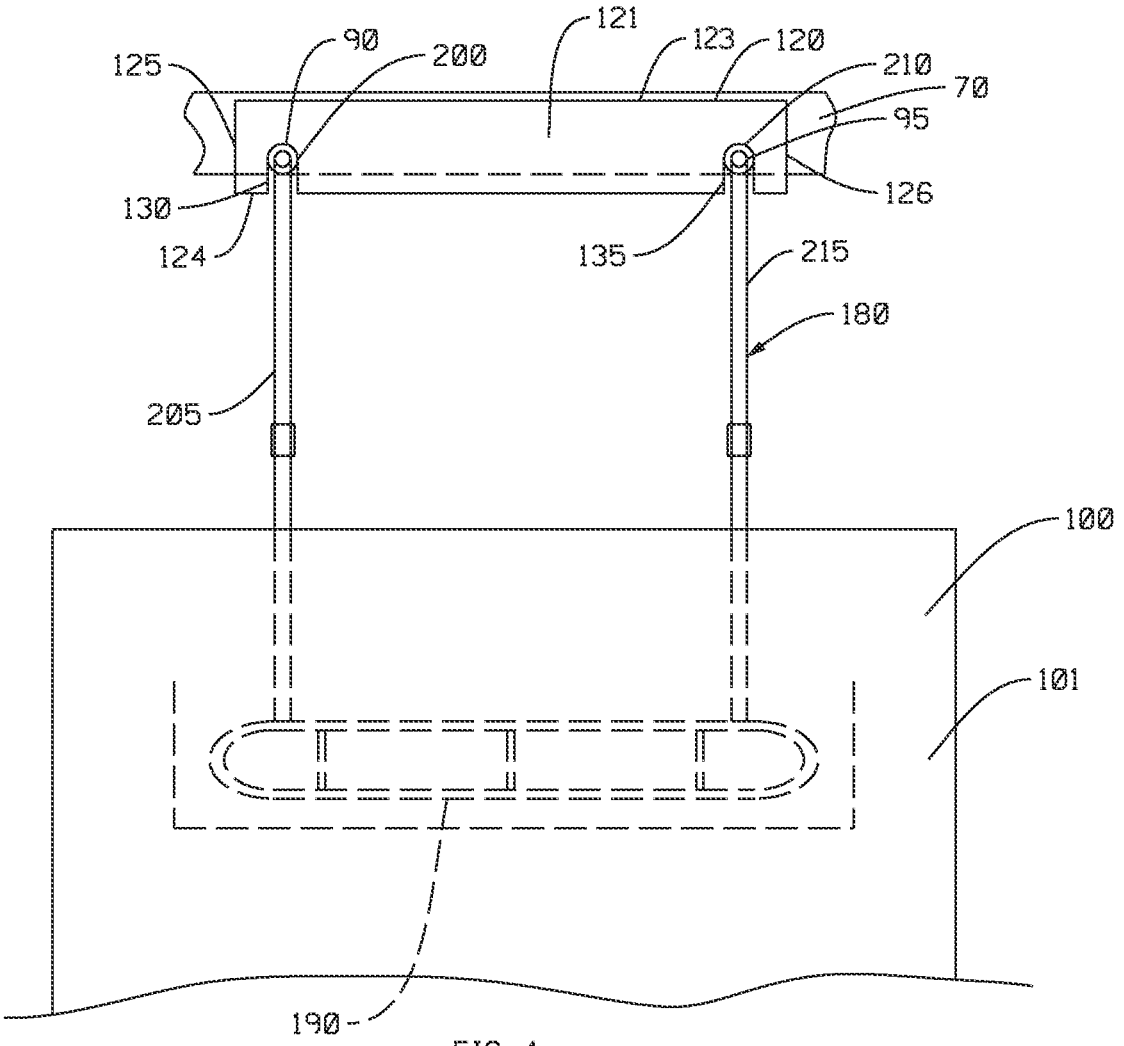
FIG. 4 is an end view of the trapeze bar.
Figure 5:
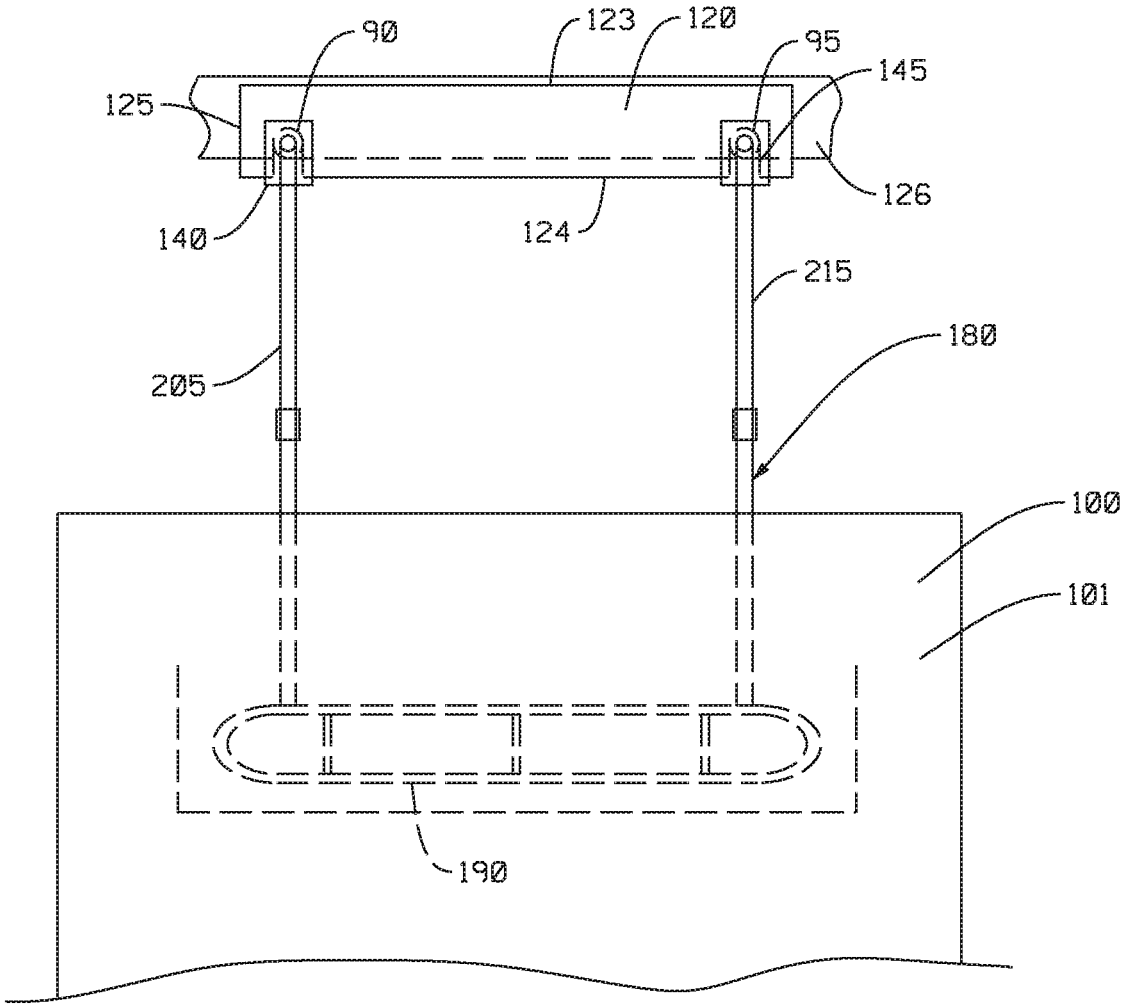
FIG. 5 is similar to FIG. 4 but shows covers in place over box slots.

Returning now to FIGS. 1-2, and also looking at FIGS. 3 and 6, it is seen that a head board 100 is provided. The head board 100 has a front 101 and a back 102. A pocket 103 is secured to the back 102 of the head board 100 for storing items behind the head board 100. It is appreciated that while the pocket 103 is illustrated as being behind the head board 100, that the pocket could also be on the front side 101 or even integrated into the interior of the head board 100 without departing from the broad aspects of the present invention.

Looking at FIGS. 3-6, it is seen that a trapeze assembly 180 is provided. The trapeze assembly 180 has a bar 190. The bar 190 is preferably an elongated bar with a length suitable to a given bed width (twin, double, queen, king, etc.). In one embodiment, the bar has a length of three feet, is rounded at the ends and has several risers. However, it is appreciated that other size and shapes, such as a triangle, could be used without departing from the broad aspects of the present invention. The bar 190 is supported by two straps 205 and 215. The straps can be made of any suitable material. Strap 205 is connected to a cuff 200. Cuff 200 surrounds brace 90 and is slideable thereon. Strap 215 is connected to a cuff 210. Cuff 210 surrounds brace 95 and is slideable thereon.

The trapeze assembly 180 can be in a deployed position wherein it is movable within the head region of the bed. The trapeze assembly 180 can also be in a storage position wherein the cuffs 200 and 210 are adjacent lateral rail 70 and the bar 190 is behind the head board 100. The bar 190 can be placed in the pocket 103 to conceal the bar 190.

A box 120 is further provided for concealing the cuffs 200 and 210. The box 120 has a front 121, a back 122, a top 123, a bottom 124 and opposed ends 125 and 126. Two slots 130 and 135 are provided, each formed in the front 121 and bottom 124. Each brace 90 and 95 passes through a vertical component of the slots 130 and 135, respectively. A cover 140 is provided for covering at least a portion of slot 130 when cuff 200 is received within the box 120. A cover 145 is provided for covering at least a portion of slot 135 when cuff 210 is received within the box 120.

The longitudinal rails 60 and 65 are taller than the longitudinal braces 90 and 95 are. In this regard, the braces 90 and 95 are naturally concealed by the rails 60 and 65.

Hence, it is seen how the trapeze assembly can be concealed when it is in the storage position.

It is appreciated that an alternative shape trapeze, such as a triangle can be used either with a strap or fixed support without departing from the broad aspects of the present invention.

Turning now to FIGS. 7-16 it is seen that an integrated assist rail 240 is provided as a part of an optional night stand 230. The night stand 230 has a top surface 235. The assist rail 240 has a plate 250 that is secured to the post 15 of the frame 10. The assist rail 240 also has a fixed section 260 and a movable section 270. The fixed section 260 has bars 262 and a fixed outer post 263 that contacts the floor. The movable section 270 has an upright 271 and bars 272. The movable section is movable between a storage position and a deployed position. In a preferred embodiment, the movement is via a pivot 280. The pivot 280 preferably has an offset pivot axis allowing the movable section 270 to be deployed to a position in line with the fixed section 260 and stored in a position parallel to the fixed section 260.

The pivot 280 has a top upper piece 290 with a hole 291, a top lower piece 300 with a hole 301, a bottom upper piece 310 with a hole 311 and a bottom lower piece 320 with a hole 321 and several perimeter holes 322 arranged in a circular pattern. The top upper piece 290 and bottom upper piece 310 are connected to the movable section 270. The top lower piece 300 and the bottom lower piece 320 are connected to post 263 of the fixed section 260. Holes 291, 301, 311 and 321 are aligned and a shaft 330 can pass through them allowing the movable section 270 to pivot relative to the fixed section 260.

A spring loaded rod 340 can be provided and integrated in upright 271 so that an end can selectably project into one of the perimeter holes 322 of the bottom lower piece 320 to lock the movable section 270 in a position (deployed, storage or intermediate) relative to the fixed section 260.

A concealer 350 is provided. The concealer 350 can be a shroud or curtain that can be selectable placed on either side of the bars 262 of the fixed section 260 for access or concealment purposes.

A concealer 355 is provided. The concealer 355 selectably conceals items within the stand 230, such as the stored movable section 270. The concealer can be supported on a rail on the underside of the night stand top 235. In this regard, it is seen how the assist rail 240 can be concealed when it is in the storage position.

It is appreciated that the movable section could be moved relative to the fixed section in different methods without departing from the broad aspects of the present invention. For example, the movable section could have rails in telescopic engagement with the rails of the fixed section.

Turning now to FIGS. 17-22, it is seen that a balance pole assembly 370 is provided. The balance pole assembly 370 has a base 380 with a lateral arm 390 and a longitudinal arm 395. A connector 400 can be at the distal end of the longitudinal arm. A structure can be provided allowing the base 380 to lay flat only at a fully retracted and fully deployed position. The base can be stored in a storage position under the mattress support 40.

A balance pole 410 has a top piece 420 with a lateral arm 425 and an upper pole arm 430. The lateral arm 425 and upper pole arm 430 are preferably at right angled to each other. The balance pole 410 has a bottom piece 440. A connector 445 is at the bottom end of the bottom piece 440. Connector 445 is removably securable to connector 400 of the base 380. A slide collar 450 can be provided and fit over a hinge 455 to lock the upper and lower pieces in alignment.

To move from the deployed to the storage position, the connectors 445 and 400 are disconnected, the collar is moved, the bottom piece is swung 180 degrees relative to the upper piece, both of the upper piece and bottom piece are rotated 90 degrees about the lateral arm 425 of the top piece so that they are parallel to the longitudinal rail 60, and the balance pole is laterally slid into close proximity to the longitudinal rail 60.

A box 150 is provided on the longitudinal rail 60. The box 150 has a front 151, a back 152, a top 153, a bottom 154, an end 155 and an end 156. An opening 160 is through the front 151 and end 155 allowing the balance pole 410 to enter the box. A cover 170 can cover the opening. In this regard, the balance pole 410 can be concealed when it is in the storage position.

Figure 23:
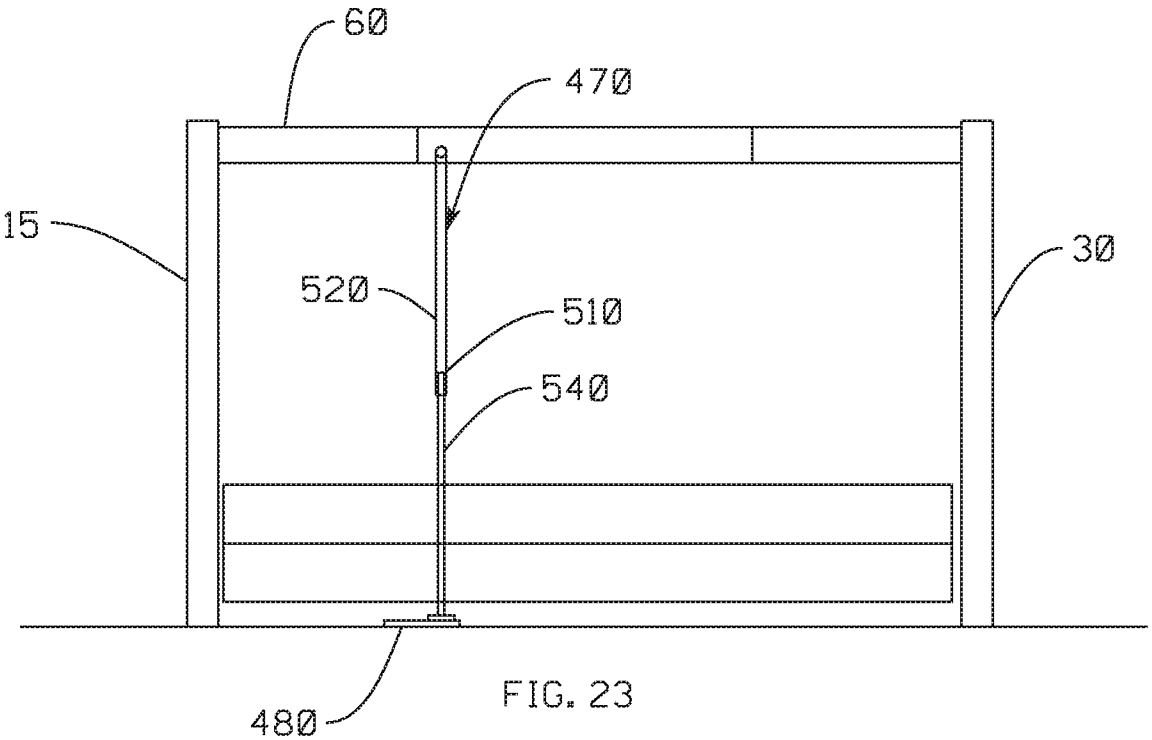
FIGS. 23-25 show a sequence of moving an alternative embodiment of a balance pole assembly from a deployed position to a storage position.
Figure 24:
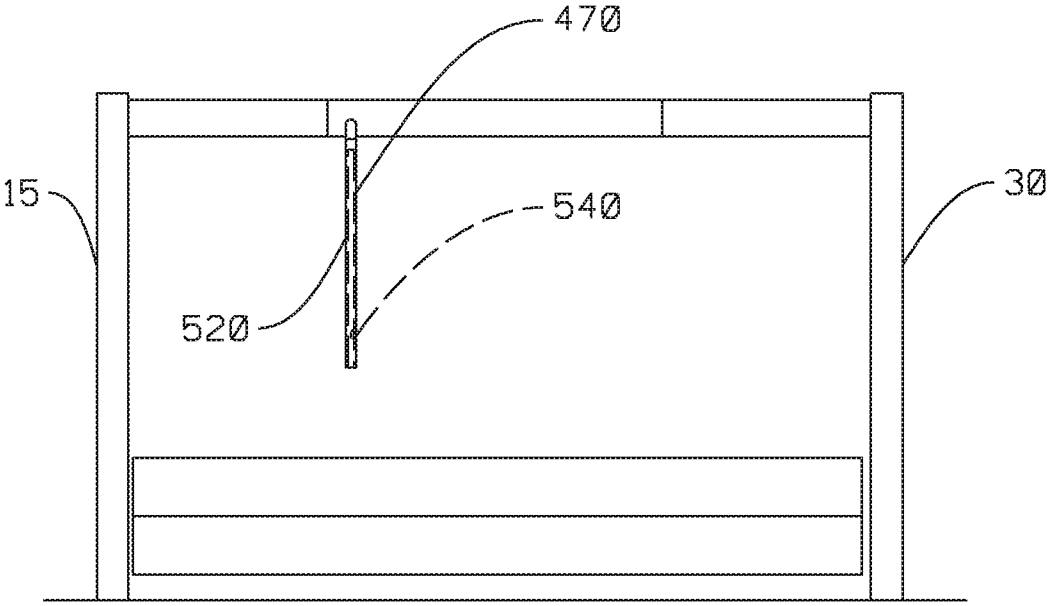
Figure 25:
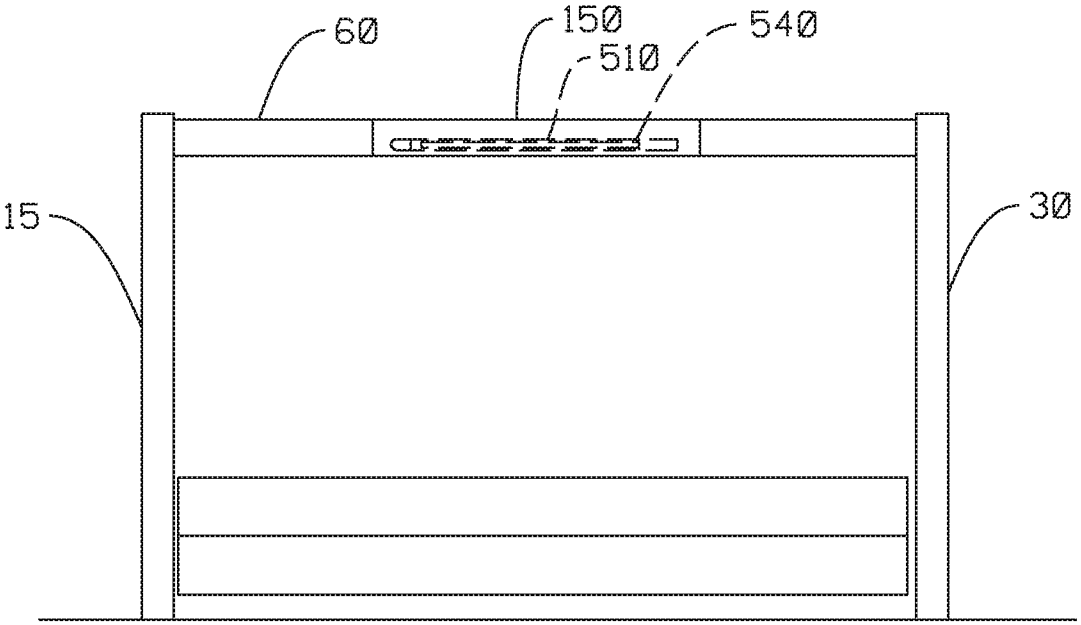

Turning now to FIGS. 23-25, it is seen that an alternative balance pole assembly 470 is provided having a base 480 and a balance pole 510 with a top piece 520 and a bottom piece 540 that are in telescopic engagement. In this regard, the bottom piece 540 telescopes into the top piece 520 (as opposed to the pivotal relationship in the prior embodiment).

Thus, it is apparent that there has been provided, in accordance with the invention, a bed frame of a canopy style construction typically found in a home setting integrating assistive components therein, exemplary assistive components optionally including one or more of a trapeze device, a balance pole and an assist rail, and also wherein there is an option that the assistive components to be selectably concealed that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A bed frame having a canopy style, said bed frame comprising:
a head board, said head board supporting a pocket;
a mattress support; and
an overbed support comprising:
a first longitudinal rail;
a second longitudinal rail;
a first lateral rail;
a second lateral rail;
a cross-brace;
a first longitudinal brace spanning between said first lateral rail and said cross-brace; and
a second longitudinal brace spanning between said first lateral rail and said cross-brace; and
a trapeze assembly having a trapeze, a first strap and a second strap, said first strap being supported by and movable relative to said first longitudinal brace and said second strap being supported by and movable relative to said second longitudinal brace, said trapeze being concealable within said pocket when not in use.

2. The bed frame of claim 1 further comprising at least one assistive component selected from a group including: a balance pole and an assist rail.

3. The bed frame of claim 2, wherein:
said bed frame further comprises a night stand;
said at least one assistive component is said assist rail; and
said assist rail comprises a first section, a second section and a pivot, said first section being fixed in a position parallel to said mattress support and said second section being pivotable between a first position parallel to and offset from said first section and under said night stand, and a second position in-line with said first section.

4. The bed frame of claim 3, wherein said pivot comprises:
a top upper piece with a top upper piece hole;
a top lower piece with a top lower piece hole, said top upper piece hole being aligned with said top lower piece hole;
a bottom upper piece with a bottom upper piece hole; and
a bottom lower piece with a bottom lower piece hole, said bottom upper piece hole being aligned with said bottom lower piece hole.

5. The bed frame of claim 4, wherein:
said bottom lower piece further has a perimeter hole; and
said bed frame further comprises:
a shaft, said shaft passing through said top upper piece hole, said top lower piece hole, said bottom upper piece hole and said bottom lower piece hole; and
a rod, said rod locking said second section in a pivotal position relative to said first section when said rod enters said perimeter hole.

6. The bed frame of claim 2, wherein:
said at least one assistive component is said balance pole;
said balance pole being concealable within a box supported by an outside surface of said first longitudinal rail when not in use.

7. The bed frame of claim 6, wherein:
said bed frame further comprises a balance pole base, said balance pole base being selectably laterally moved with respect to said bed frame between a deployed position and a storage position; and
said balance pole is connected to said balance pole base when said balance pole is in a position for use.

8. A bed frame having a canopy style, said bed frame comprising:
a first longitudinal rail;
a second longitudinal rail;
a first lateral rail;
a second lateral rail;
a cross-brace;
a first longitudinal brace supporting a first strap;
a second longitudinal brace supporting a second strap;
a head board;
a trapeze supported by said first strap and said second strap;
a first cuff being slidable with respect to said first longitudinal brace and directly supporting said first strap;
a second cuff being slidable with respect to said second longitudinal brace and directly supporting said second strap; and
a box, said box being connected to said first lateral rail to selectably conceal said first cuff and said second cuff when said first cuff and said second cuff are received within said box,
wherein said trapeze is concealable behind said head board when not in use and said first cuff and said second cuff are received within said box.

9. The bed frame of claim 8 further comprising a night stand and an assist rail, said assist rail comprising:
a first section;
a second section; and
a pivot comprising:
a top upper piece with a top upper piece hole;
a top lower piece with a top lower piece hole, said top upper piece hole being aligned with said top lower piece hole;
a bottom upper piece with a bottom upper piece hole;
a bottom lower piece with a bottom lower piece hole and a perimeter hole, said bottom upper piece hole being aligned with said bottom lower piece hole;
a shaft, said shaft passing through said top upper piece hole, said top lower piece hole, said bottom upper piece hole and said bottom lower piece hole; and
a rod,
wherein:
said first section is fixed in a position parallel to said mattress support and said second section being pivotable between a first position parallel to and offset from said first section and a second position in-line with said first section, said second section being below said night stand when in said first position; and
said rod locks said second piece in a pivotal position relative to said first piece when said rod enters said perimeter hole.

10. The bed frame of claim 8 further comprising a balance pole assembly, said balance pole assembly comprising:
a balance pole, said balance pole being concealable within a balance pole box supported by said first longitudinal rail when not in use; and
a balance pole base, said balance pole base being selectably laterally moved with respect to said bed between a deployed position and a storage position, wherein said balance pole is connected to said balance pole base when said balance pole is in a position for use.

11. A bed frame having a canopy style, said bed frame comprising:
a head board, said head board supporting a pocket;
a mattress support;
a night stand adjacent to said mattress support and said head board;
an overbed assembly having a first longitudinal rail, a second longitudinal rail, a first lateral rail, a second lateral rail, a cross-brace, a first longitudinal brace between said first lateral rail and said cross-brace, and a second longitudinal brace between said first lateral rail and said cross-brace, said overbed assembly further having a first longitudinal rail box on a side of said first longitudinal rail;

a trapeze supported by a first strap and a first cuff, said first cuff being supported by said first longitudinal brace, said trapeze also being supported by a second strap and a second cuff, said second cuff being supported by said second longitudinal brace, said trapeze being selectably positioned in a deployed trapeze position over said mattress support and a concealed trapeze position within said pocket;

a balance pole, said balance pole being selectably positioned in a deployed balance pole position upright adjacent to said mattress support and a concealed balance pole position within said first longitudinal rail box; and a side assist rail having a first section and a second section, said second section being pivotal relative to said first section wherein said side assist rail can be deployed in a first position wherein said second section is in-line with said first section adjacent to said mattress support and concealed in a second position wherein said second section is parallel to and offset from said first section under said night stand.

12. The bed frame of claim 11 further comprising:

a first lateral rail box, said first lateral rail box being connected to an interior side of said first lateral rail to selectably receive and conceal said first cuff and said second cuff when said trapeze is concealed within said pocket.

13. The bed frame of claim 11, wherein:

said bed frame further comprises a balance pole base, said balance pole base being selectably laterally moved with respect to said bed frame between a deployed position and a storage position; and said balance pole is connected to said balance pole base when said balance pole is in a position for use.

14. The bed frame of claim 11, wherein said assist rail comprises:

a pivot comprising:

a top upper piece with a top upper piece hole;

a top lower piece with a top lower piece hole, said top upper piece hole being aligned with said top lower piece hole;

a bottom upper piece with a bottom upper piece hole;

a bottom lower piece with a bottom lower piece hole and a perimeter hole, said bottom upper piece hole being aligned with said bottom lower piece hole;

a shaft, said shaft passing through said top upper piece hole, said top lower piece hole, said bottom upper piece hole and said bottom lower piece hole; and a rod, wherein:

said rod locks said second piece in a pivotal position relative to said first piece when said rod enters said perimeter hole.

15. A bed frame having a canopy style, said bed frame comprising:

a mattress support;

a night stand adjacent to said mattress support; and an assist rail, said assist rail having a first section, a second section and a pivot, said second section being pivotably connected to said first section with said pivot, said first section being fixed in a position below said night stand and parallel to said mattress support and said second section being pivotable 180 degrees between a first position parallel to and offset from said first section and a second position in-line with said first section, wherein when in said first position, said second section is below said night stand.

16. The bed frame of claim 15, wherein said pivot comprises:

a top upper piece with a top upper piece hole;

a top lower piece with a top lower piece hole, said top upper piece hole being aligned with said top lower piece hole;

a bottom upper piece with a bottom upper piece hole; and a bottom lower piece with a bottom lower piece hole, said bottom upper piece hole being aligned with said bottom lower piece hole.

17. The bed frame of claim 16, wherein:

said bottom lower piece further has a perimeter hole; and said bed frame further comprises:

a shaft, said shaft passing through said top upper piece hole, said top lower piece hole, said bottom upper piece hole and said bottom lower piece hole; and a rod, said rod locking said second section in a pivotal position relative to said first section when said rod enters said perimeter hole.

18. A bed frame having a canopy style, said bed frame comprising:

a mattress support;

an overbed support having a first longitudinal rail, a second longitudinal rail, a first lateral rail and a second lateral rail, said overbed support having a box on said first longitudinal rail; and a balance pole, said balance pole being selectably positioned in either a first position that is upright and adjacent to the bed frame and a second position that is received within said box.

19. The bed frame of claim 18, wherein:

said box has a front with an opening therethrough, and said balance pole base is selectably rotated relative to said first longitudinal rail and then laterally moved through said opening to move said balance pole from said first position to said second position.

20. A bed frame having a canopy style, said bed frame comprising:

a head board;

a mattress support;

an overbed assembly having a first longitudinal rail, a second longitudinal rail, a first lateral rail, a second lateral rail, a cross-brace, a first longitudinal brace between said first lateral rail and said cross-brace, and a second longitudinal brace between said first lateral rail and said cross-brace;

a trapeze supported by a first strap and a first cuff, said first cuff being supported by said first longitudinal brace, said trapeze also being supported by a second strap and a second cuff, said second cuff being supported by said second longitudinal brace, said trapeze being movable to a selected position relative to said first longitudinal brace and said second longitudinal brace; and a balance pole, said balance pole being supported by said first longitudinal rail.

21. The bed frame of claim 20 wherein said balance pole is selectably positioned in either of a first position that is upright and adjacent to said mattress support and a second position that is adjacent to said first longitudinal rail wherein said balance pole is twisted relative to said first longitudinal rail so that a balance pole longitudinal axis is parallel to a first longitudinal rail longitudinal axis.

* * * * *